United States Patent [19]

Logsdon

[11] 3,976,244

[45] Aug. 24, 1976

[54] ADJUSTABLE AIR VOLUME REGULATOR HAVING THERMAL MOTOR ACTUATOR FOR EFFECTING ADJUSTMENT

[75] Inventor: Hillard Glenn Logsdon, Charlotte, N.C.

[73] Assignee: Aeronca, Inc., Pineville, N.C.

[22] Filed: Sept. 3, 1974

[21] Appl. No.: 502,404

Related U.S. Application Data

[63] Continuation-in-part of Ser. No. 491,696, July 25, 1974.

[52] U.S. Cl. ..... 236/49; 236/68 R; 251/11

[51] Int. Cl.[2] ..... F24F 11/02

[58] Field of Search ..... 236/49, 68 R; 251/11, 251/212, 285; 137/517, 614.19, 613

[56] References Cited

UNITED STATES PATENTS

| | | | |
|---|---|---|---|
| 3,208,218 | 9/1965 | Schelin | 251/285 X |
| 3,255,963 | 6/1966 | Gorchev et al. | 236/49 X |
| 3,276,480 | 10/1966 | Kennedy | 137/517 X |
| 3,394,769 | 7/1968 | Smith et al. | 137/517 X |
| 3,718,156 | 2/1973 | Fujii | 137/517 X |
| 3,743,182 | 7/1973 | Harmon | 236/49 X |
| 3,790,122 | 2/1974 | Weinstein | 236/68 R X |

OTHER PUBLICATIONS

Air Conditioning, Heating & Ventilating, Sept. 1960 pp. 81–83.

*Primary Examiner*—William E. Wayner
*Attorney, Agent, or Firm*—Bell, Seltzer, Park & Gibson

[57] ABSTRACT

An apparatus for adjustably controlling the flow of air in an air conditioning system and comprising a regulator having flow control means movable in response to fluctuations in the pressure of the air supplied to the regulator for maintaining the flow of air passing through the regulator at a substantially constant rate and having flow adjustment means cooperating with the flow control means for permitting varying the flow rate maintained by the flow control means. In order to effect adjustment of the flow rate through the regulator, an actuator device is provided cooperating with the flow adjustment means and comprising a thermal motor having an axially movable shaft extending therefrom, a heater cooperating with the thermal motor for applying heat thereto to effect an axial movement to the motor shaft, and linkage cooperating with the motor shaft and operatively connecting the same to the flow adjustment means for effecting adjustment of the rate of flow through the regulator in response to the axial movement of the motor shaft.

11 Claims, 5 Drawing Figures

ADJUSTABLE AIR VOLUME REGULATOR HAVING THERMAL MOTOR ACTUATOR FOR EFFECTING ADJUSTMENT

This application is a continuation-in-part of my commonly assigned copending application Ser. No. 491,696, filed July 25, 1974, and entitled AIR VOLUME REGULATOR FOR AIR CONDITIONING SYSTEMS.

This invention relates to air conditioning systems and more particularly to an improved apparatus adapted for adjustably controlling the flow of air being delivered to an air conditioned room or zone.

In air conditioning systems where air is supplied from a central conditioning device to a plurality of individual distributing units or terminals, changing demands for air in the rooms or zones being conditioned will cause pressure variations in the air supply lines or ducts with resulant variations in the volume of air flowing therethough. Accordingly, the individual air distributing units are conventionally provided with air volume regulators adapted for maintaining a substantially constant volume flow of air therethrough regardless of variations in pressure in the air delivery lines leading thereto.

In many systems, and especially in variable volume air conditioning systems wherein the rate of flow of air being supplied to the room or zone is varied in response to changing room conditions or demands, the regulators also include means for varying the volume setting or air flow rate to the room or zone in response to the changing conditions or demands. Adjustment of the volume setting is conventionally effected by well-known types of actuators.

One form of actuator commonly employed for adjustment of volume regulators is the well-known type of pneumatic actuator which employs pressurized air to move a diaphragm or piston to, in turn, move an actuator rod connected to the regulator. However, such pneumatic actuators are bulky, heavy, and relatively expensive. Further, the pneumatic actuators are expensive to install since they require a source of compressed air and the use of relatively expensive pneumatic control thermostrats and pneumatic control lines associated therewith. While various types of electrically operated actuators have also been proposed, none are entirely satisfactory, since those having sufficient power for use with volume regulators are also relatively bulky, heavy, and expensive.

With the foregoing in mind, it is a primary object of the present invention to provide an apparatus for adjustably maintaining the volumertric flow of air being delivered to a room or zone substantially constant at a desired setting, and wherein adjustment of the volume setting is accomplished by an actuator of improved design employing a thermal motor.

It is a further object of the invention to provide an apparatus of the type described wherein adjustment of the volume setting is effected automatically in response to a demand for an increase or decrease flow of air through the apparatus.

The apparatus of this invention includes a regulator having flow control means movable in response to fluctuations in the pressure of the air supplied to the regulator for maintaining the flow of air passing through the regulator at a substantially constant rate. The regulator is also provided with flow adjustment means cooperating with the flow control means for permitting varying the flow rate maintained by the flow control means. In order to effect adjustment of the flow rate through the regulator, actuator means is provided cooperating with the flow adjustment means and comprising a thermal motor having an axially movable shaft extending therefrom, heating means cooperating with the thermal motor for applying heat thereto effect an axial movement to the motor shaft, and means cooperating with the motor shaft and operatively connecting the same to the flow adjustment means for effecting adjustment of the rate of flow through the regulator in response to the axial movement of the motor shaft.

In accordance with one aspect of the invention, the actuator means cooperating with the flow adjustment means includes thermostat means for sensing the demand for an increased or decreased flow of air, and the actuator means is responsive to the sensed demand for varying the flow adjustment means accordingly.

The use of a thermal motor in the actuator means as the prime mover for effecting adjustment of the flow rate through the regulator has significant advantages over conventional pneumatically or electrically operated prime movers. The thermal motor is reliable and is relatively inexpensive. Further, it is extremely high-powered for its compact size. Additionally, the thermal motor may be operated by a conventional low voltage power source and permits the use of relatively inexpensive electric thermostats and control wiring rather than the more expensive pneumatic control thermostat which require pneumatic control lines and an air pressure source associated therewith.

In accordance with the preferred form of the invention illustrated, the actuator means is employed with a regulator wherein the flow control means for maintaining a substantially constant flow of air through the regulator includes a pair of airfoils mounted in opposing relation to one another in the path of air flow and movable in response to fluctuations in the pressure of the air supplied to the regulator to define an air passageway of variable size.

The flow adjustment means in this preferred form of regulator for varying the flow rate maintained through the regulator includes adjustable gate means located upstream of the pair of airfoils and in the path of air flow thereto, and the actuator means serves to effect adjustment of the position of the gate means to vary the amount of airfoil surface exposed to the air flow and thereby vary the flow rate maintained through the regulator.

Some of the objects and advantages of the invention having been stated, others will appear as the description proceeds, when taken in connection with the accompanying drawings, in which --

Figure 1:
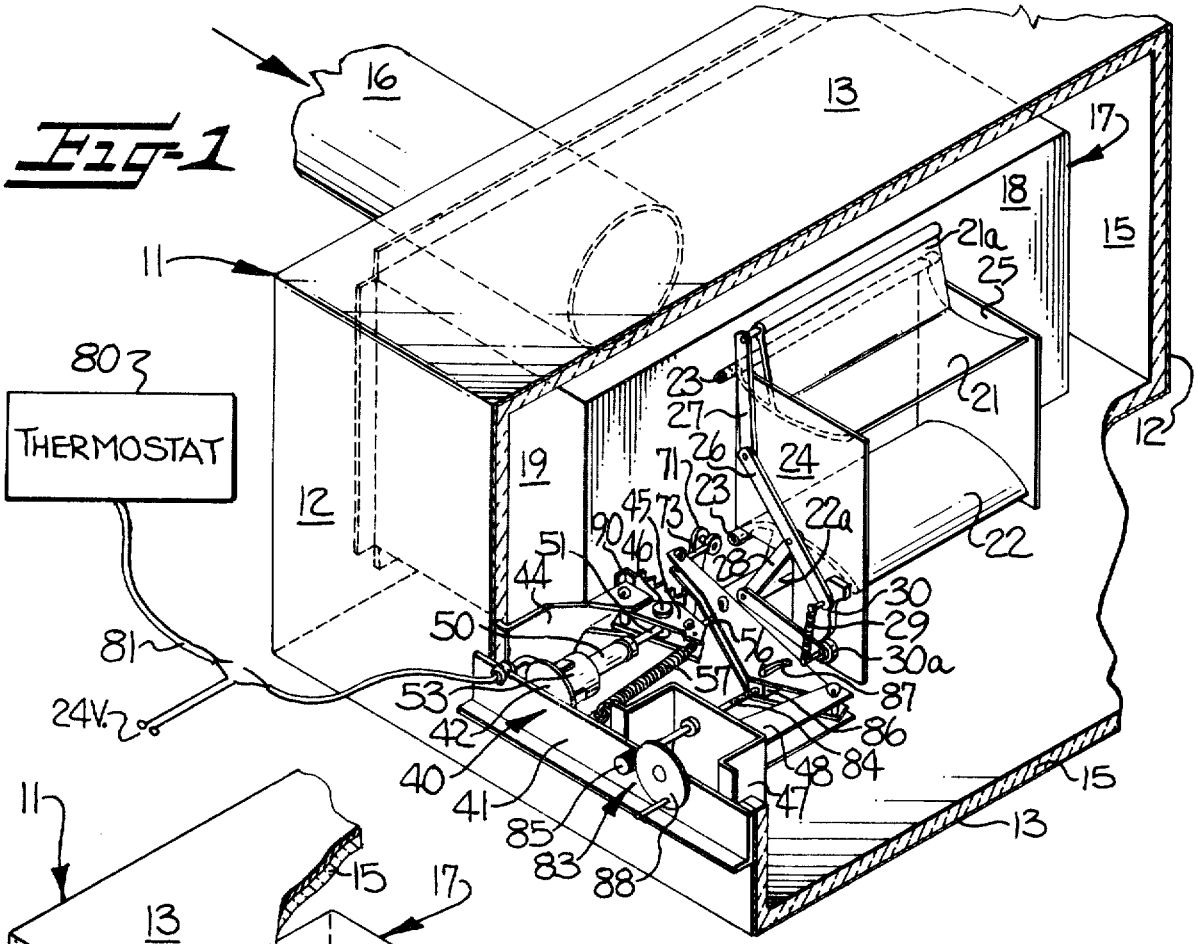
FIG. 1 is an isometric view, with parts broken away, of a portion of an air distribution unit employing an apparatus in accordance with this invention.

Referring now more particularly to the drawings, FIG. 1 illustrates an air distribution unit or terminal adapted for being installed in a central air conditioning system for controlling the flow of conditioned air into an air conditioned room or zone. The air distribution unit includes a hollow generally rectangular housing, generally indicated at 11, having an opposing pair of side walls 12 and opposing upper and lower walls 13 and having an end wall 14 at the upstream end thereof. As is conventional, the inner surfaces of the walls of housing 11 are lined with suitable thermal and sound insulating material 15. An air distribution or supply duct 16 supplying conditioned air under relatively high pressure from a central conditioning device communicates with housing 11 through an opening in end wall 14 thereof.

Positioned within housing 11 in communication with air distribution duct 16 and carried by upstream end wall 14 of housing 11 is an inner conduit or duct, generally indicated at 17, which is cantilever mounted from housing 11. As illustrated, conduit 17 has a downstream end wall 18 which is cantilever supported by pairs of opposing parallel generally rectangular side walls 19 which, in turn, are mounted on end wall 14 and extend within housing 11 in spaced apart relation from the walls 12 and 13 thereof. End wall 18 has a generally rectangular opening therein for the flow of air therethrough and additionally serves as a supporting wall for component parts of the volume regulator which are mounted on opposite sides of the wall 18 adjacent the opening therein.

Conduit 17 serves as an expansion chamber for the relatively high pressure air being delivered from supply duct 16 and also serves for absorbing and dampening vibrations created by the air flowing through the regulator to avoid transmitting the vibrations to the walls of housing 11. The use of a cantilever mounted conduit of the type illustrated for supporting the regulator within the housing of the air distribution unit is the preferred mounting arrangement for the regulator for the reasons, noted, but it will be appreciated that the regulator may also be mounted by other means in air conditioning systems using various other types of ducts or housing conveying air under either relatively high or low pressure.

As noted earlier, the apparatus of this invention includes a regulator having flow control means adapted for maintaining the flow of air passing through the regulator at a substantially constant rate regardless of fluctuations in upstream pressure. In the embodiment of the invention illustrated, it will be seen that the flow control means includes a pair of airfoils, generally indicated at 21 and 22, carried by and mounted adjacent to the opening in supporting wall 18 in opposing relation to one another for receiving therebetween the flow of air from the opening. More particularly, it will be seen that the opposing airfoils 21, 22 have their leading edges extending generally parallel to one another along opposite sides of the opening in wall 18 with trailing portions of the airfoils extending in opposing relation in the downstream direction. The airfoils are mounted for pivotal movement adjacent their leading edges by suitable means, such as hinge means 23, which are carried by wall 18 of conduit 17.

The opposing facial surfaces of the airfoils 21 and 22 are shaped so that the air flowing thereacross will exert a force on the respective opposing airfoils to pivotally move the same relative to one another. While the particular configuration of the airfoil surfaces may take various forms, in the embodiment of the invention illustrated, the airfoils are in the form of curved blades of a generally cylindrical nature having similar generally convex curved facial surfaces along the direction of air flow and having a uniform cross section and surface configuration in the direction transverse to the direction of air flow. The airfoils may be economically formed by conventional extrusion methods from any suitable material, as for example aluminum alloy.

In operation, the freely movable opposing airfoils tend to "float" in the stream of air passing thereover and, in accordance with aerodynamic principles, move relative to one another in response to fluctuations in upstream pressure, varying the size of the air passageway therebetween and thereby maintaining the flow of air through the regulator substantially constant. Simply stated, the higher the air velocity over the airfoil surfaces, the greater the "lift" created by the air movement. Therefore, as the air velocity increases through the regulator due to an increase in total pressure upstream of the regulator, the airfoils are drawn together, restricting the air passageway therebetween so that a constant volumetric flow rate of air is maintained. When the air velocity across the airfoil surfaces decreases, as would occur for example upon a demand for an increased flow of air elsewhere along the air supply duct, the decreased "lift" resulting therefrom permits the opposing airfoils to be pushed further apart so that the size of the air passageway is increased and the flow of air from the regulator is maintained at a substantially constant rate. It will thus be appreciated that the airfoils operate to maintain constant air flow without the need for an external power source as is required in some types of known air volume regulators, and without the necessity of employing a spring or other biasing means as is employed in the operation of most conventional self-contained or non-powered air volume regulators.

The curved cylindrical shape of the airfoil surfaces in accordance with the illustrated form of the invention effectively maintains substantially uniform flow control over a wide range of upstream pressures and advantageously avoids appreciable fluttering of the airfoils during operation. Referring more particularly to the shape of the airfoils, it will be noted that the convex curvature in each of the airfoils has a plurality of different radii, with the radius of curvature being smallest adjacent the leading edge of the airfoil and increasing in the downstream direction. At any pivotal position assumed by the opposing airfoils, this curvature may be viewed as defining an ASME nozzle configuration in two dimensions between the leading edges of the opposing airfoils and the point of tangency of the airstream on the tailing portions of the airfoils.

As illustrated, a pair of opposing fixed parellel walls 24 and 25 are positioned closely adjacent lateral edges of trailing portions of the opposing airfoils 21 and 22 and cooperate with the airfoils so that the restricted passageway downstream of the opening in the supporting wall is enclosed on all sides.

Additionally, linkage means is provided interconnecting the opposing airfoils so that the airfoils move in unison toward or away from each other. Referring more particularly to FIG. 1, it will be seen that each airfoil 21, 22 has integrally formed therewith a leg **21*a*, 22*a* extending rearwardly away from the curved surface of the airfoil member and serving to facilitate interconnecting the opposing airfoils. A central link 26 is pivotally connected to wall 24 adjacent one side of the opposing airfoils and respective link arms 27 and 28 serve to interconnect the legs 21***a*, 22*a* of the airfoils with the central link 26 so that the opposing airfoils operate in unison in opposition to one another.

In order to more accurately maintain the flow of air through the regulator at a substantially constant rate, the volume regulator is illustrated as being provided with a spring 29 and a compensating cam 30 having a configured cam surface and having a cam follower 30*a* cooperating therewith. The compensating cam assembly and spring 29 cooperates with the airfoils for exerting a bias on the airfoils which varies in accordance with the positions of the airfoils relative to one another. This variable opening bias is effective over intermediate positions of the airfoils relative to one another and serves to alter slightly the position ordinarily assumed by the airfoils over intermediate ranges of static pressure so as to upwardly adjust the flow rate permitted over these ranges of static pressures.

Figure 2:
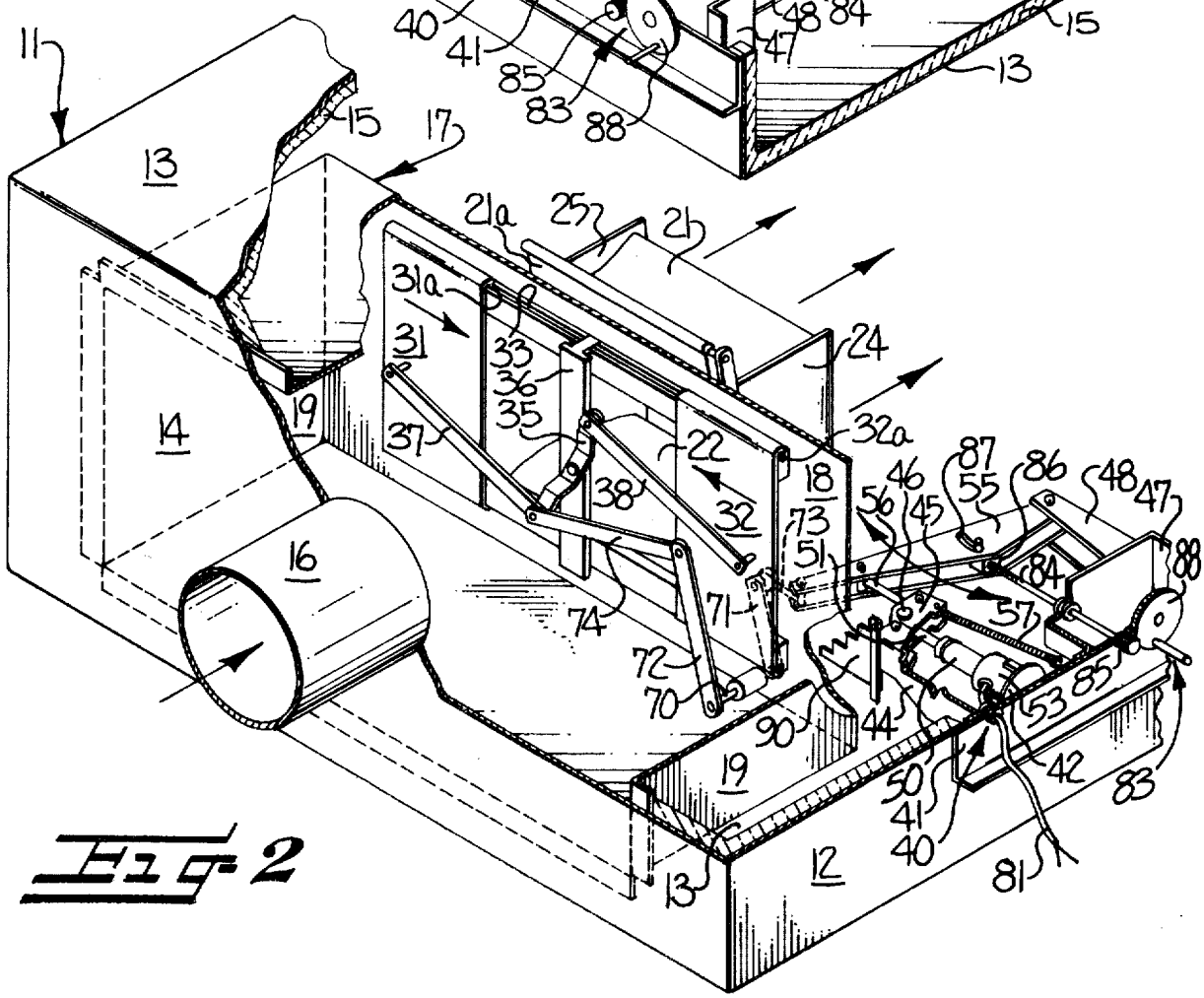
FIG. 2 is an isometric view, with parts broken away, of the air distribution unit illustrated in FIG. 1, as viewed from the opposite end thereof and looking in the downstream direction.

In order to permit varying the flow rate maintained through the regulator, flow adjustment means is provided in the regulator. As illustrated, this flow adjustment means is located upstream of the airfoils and in the path of air flow thereto and cooperates with the airfoils for varying the flow rate maintained by the airfoils over a wide range of flow rates. Referring more particularly to FIG. 2, it will be seen that the flow adjustment means comprises adjustable gate means in the form of a pair of opposing gates 31 and 32 which are mounted on the upstream side of supporting wall 18 for sliding movement along a direction parallel to the leading edges of the airfoils so as to thereby vary the effective lateral extent of the airfoil surface exposed to the air flow. The spacing or distance between the slideably mounted gates 31 and 32 may be varied as desired from a fully opened position wherein the entire lateral extent of the airfoils is exposed to the air flow and a maximum air flow is obtained to a fully closed condition wherein the flow of air from the regulator is stopped, and through an infinite number of intermediate positions providing an infinite number of intermediate flow rates.

Gates 31 and 32 are provided with suitably turned lips 31*a*, 32*a* at the upper and lower ends thereof adapted for riding in corresponding grooves in upper and lower trackways 33 and 34 carried by supporting wall 18. The sliding gates 31 and 32 are interconnected for movement in unison toward or away from one another by suitable linkage means including a central pivotally mounted link 35 supported between the gates by a medial vertically extending strut 36, with link arms 37 and 38 interconnecting the gates 31 and 32 with the central link 35.

Suitable resilient sealing means, such as felt strips 39 (FIG. 3) may also be provided between the supporting wall 18 and gates 31 and 32 for preventing unwanted flow of air therebetween. Similarly, resilient seals or gaskets 36*a* may be provided in the T-shaped central strut 36 to permit effecting a tight seal when gates 31 and 32 are in fully closed position so that the flow of air from the regulator may be fully stopped, when desired.

It will be appreciated that since the volume control gates 31 and 32 move perpendicular to the air flow rather than in opposition thereto, they may be adjusted with a relatively small amount of force regardless of the amount of air pressure exerted thereon.

Adjustment of the volume setting of the regulator is accomplished by actuator means which cooperates with the gates 31 and 32 for effecting movement of the same in response to a demand for increased or decreased flow of air through the regulator. The actuator means employs as a prime mover a well-known temperature responsive thermal motor 50 or "power pill" of the type commonly employed in motor vehicle cooling systems and the like. Such thermal motor has a hollow housing having sealed therein a temperature responsive material, such as wax or a mixture of wax and a filler material such as metal filings, which expands and contracts in response to variations in temperature. An axially movable shaft 51 extends from one end of the motor housing which, as illustrated, is adapted to move axially from a retracted position to an extended position upon a predetermined increase in temperature of the thermal motor. Thermal motors of this type are well known and are commercially available from the Fulton-Sylphon Division of Robertshaw Controls Company. Accordingly, a further detailed description of their structure and operation is not deemed necessary.

The actuator means also includes heating means positioned in heat transferring relatino to the thermal motor 50 for applying heat thereto to effect movement of the motor shaft 51. As illustrated, the heating means comprises a heater 53 in the form of a coil of electrical resistance wire positioned surrounding the thermal motor housing for applying heat therto upon application of electric current to the resistance wire. The resistance winding of heater 53 is connected to a conventional low voltage power source, such as a 24 volt thermostat circuit, and generates heat when energized so as to effect movement of the motor shaft to an extended position. The watt density of the heater coil is sufficiently low that the heater may operate continuously for an indefinite period of time without overheating or burning out the resistance windings. Motor shaft 51 is operatively connected to the adjustable gate means 31 and 32 by suitable linkage means, to be described presently, so that axial movement of motor shaft 51 effects adjustment of the adjustable gates.

For convenience in assembling the air distribution unit, several of the component parts of the actuator means are grouped in a modular control subassembly, generally indicated at 40, which is mounted at an accessible location on housing 11 and is operably connected to the adjustable gate means. The control subassembly 40 includes a base plate 41 mounted through an opening in one of the side walls 12 of housing 11. As illustrated, the thermal motor 50 and heater 53 are secured to base plate 40 of the control subassembly by a mounting socket 42 having a plurality of short legs 43 extending outwardly therefrom for grippingly engaging the outer surface of heater 53 and retaining the heater and the thermal motor 50 in place. An elongate support bracket 44 extends inwardly within housing 11 from base plate 41 alongside the thermal motor 50, and a bifurcated lever 45 is pivotally connected at one end thereof to bracket 44 and has legs extending on opposite sides of motor shaft 51. Motor shaft 51 is pivotally connected to lever 45 through a pivot pin 46 pivotally carried in a medial portion of lever 45 and having a hole or socket therein for receiving the outermost end portion of motor shaft 51. Thus it will be seen that an axial movement of motor shaft 51 will effect a pivotal movement Also carried by base plate 41 adjacent to thermal motor 50 is a generally U-shaped frame member 47 which extends inwardly from base plate 41 and which has a support bracket 48 connected thereto and extending inwardly within housing 11. An elongate pivot arm 55 has one end thereof pivotally mounted to the innermost end of support bracket 48 and has the opposite end extending upstream therefrom adjacent to lever 45. A connecting link 56 pivotally interconnects the free end portion of lever 45 with a medial portion of pivot arm 55. The linkage just described, which forms a part of the actuator means, thus comprises a series of levers which will be seen to effect a relatively large movement to the free end of pivot arm 55 upon a relatively short stroke of movement of motor shaft 51. This permits imparting a relatively large movement to the adjustable gate means by the relatively short stroke of movement of the motor shaft 51.

The acutator means also includes biasing means, shown in the form of a coil tension spring 57, serving to return motor shaft to an axially retracted position upon cooling of thermal motor 50. Coil tension spring 57 has one end thereof connected to the free end portion of lever 45 and has the opposite end thereof connected to base plate 41 and also serves to bias the adjustable gates toward a closed position when motor shaft 51 moves toward an axially retracted position upon cooling of the thermal motor 50.

Referring again to the drawings, as best seen in FIG. 2, the actuator means also includes linkage interconnecting the outer end of pivot arm 55 with the gates 31 and 32 so that pivotal movement of arm 55 will effect opening and closing of the gates. A stub shaft 70 extends through wall 18 of conduit 17 and has a relatively short crank arm 71 on the downstream end thereof and a longer crank arm 72 on the upstream end thereof. A relatively short connecting link 73 interconnects the end of pivot arm 55 to the free end of crank arm 71. A connecting link 74 interconnects the free end of crank arm 72 on the upstream side of wall 18 with one end of central link 35. Thus, it will be seen from FIG. 2 that when the motor shaft 51 moves axially toward an extended position, pivot arm 55 is pivotally moved toward the interior of the housing and the connecting linkage through wall 18 of conduit 17 effects an opening movement to the opposing gates 31 and 32. Similarly, upon cooling of the thermal motor and movement of motor shaft 51 to a retracted axial position, gates 31 and 32 are moved toward a closed position.

Depending upon the particular system in which the air distribution unit is installed, it may be desirable in some circumstances, to have the gates 31 and 32 move toward a closed position when heat is applied to the thermal motor. Reversal of the operational of the gates may be accomplished simply by moving connecting link 74 to the opposite end of the central link 35 from that illustrated.

As illustrated, a thermostat 80, located remotely of the regulator, is operatively connected to the heater 53 through suitable wiring 81 and serves to control operation of the thermal motor in response to varying ambient conditions to thereyb effect movement of gates 31 and 32 through an infinite number of different volume settings between the fully open position and the closed position. The temperature of motor 50, and thus the position of motor shaft 51, is varied depending upon the amount of time the heater 53 remains energized, as determined by the cycling of thermostat 80 under the ambient temperature conditions. Ordinarily in variable volume air conditioning systems, the thermostat 80 would be positioned in the room or zone being conditioned so as to sense the temperature in the room and in response thereto cause an increased or decreased flow of air through the regulator into the room or zone as required.

In certain installations it may be desirable to effect adjustment of the volume setting of the regulator in response to conditions other than temperature. It will be readily appreciated by those skilled in the art that the actuator means of this invention may include a control device other than the thermostat 80 illustrated, as for example a pressure sensor or humidistat.

Figure 3:
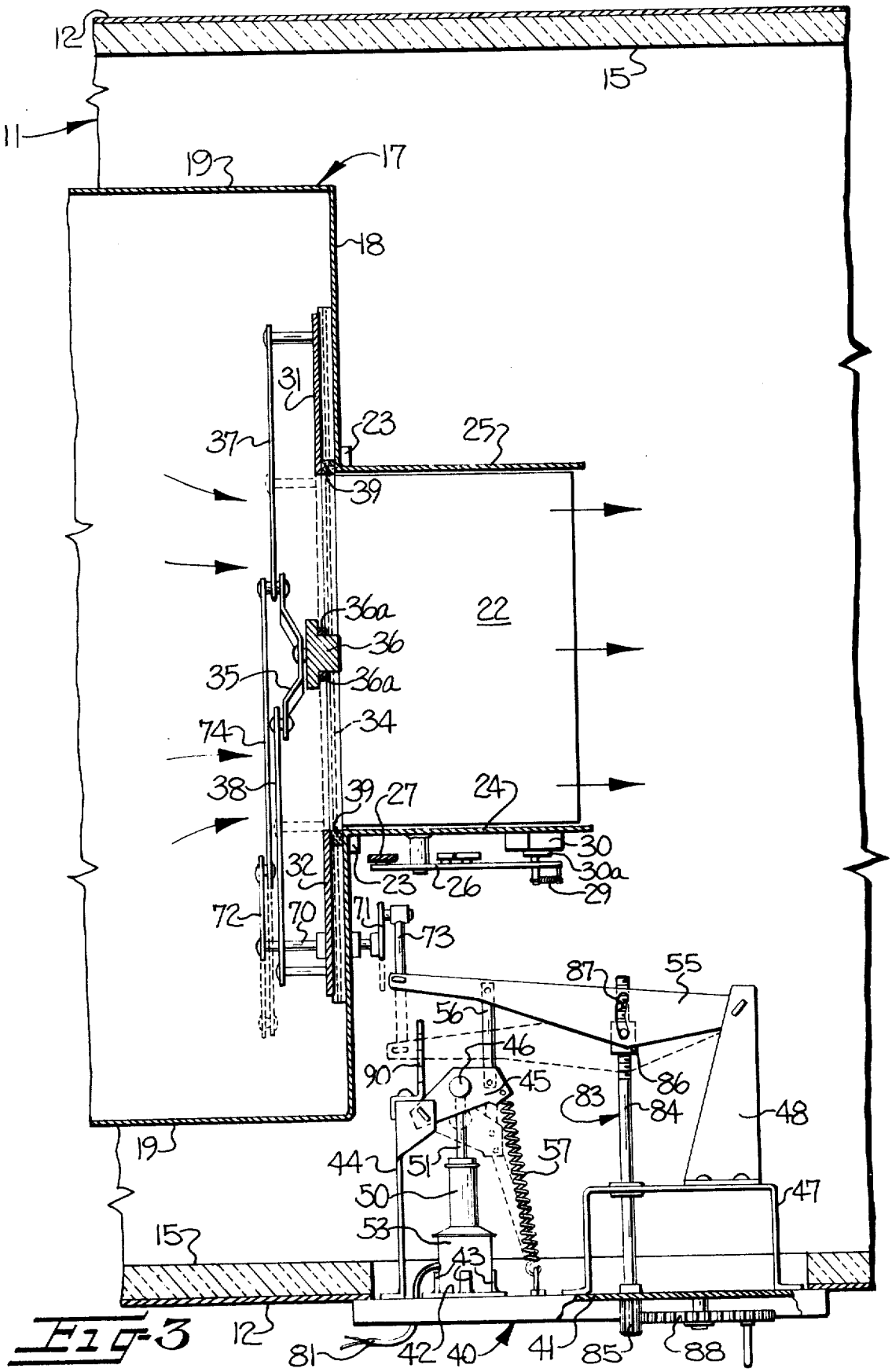
FIG. 3 is a horizontal sectional view of the portion of the apparatus shown in FIGS. 1 and 2.

As illustrated, the volume regulator also includes adjustable limit means associated with the flow adjustment means for limiting the adjustment of the rate of flow by the actuator means within a predetermined range of flow rates. As illustrated, the adjustable limit means is located on control subassembly 40 and includes both maximum and minimum limit means for limiting the adjustment of the regulator between predetermined maximum and minimum adjustable limits. The adjustable maximum limit is obtained by limit assembly 83 which includes a rotatable shaft 84 extending through frame member 47 and base plate 41 and having a small gear 85 carried on the outer end portion thereof exteriorly of the housing. The inner end portion of shaft 84 is threaded and has a cooperating threaded slide member 86 carried thereby. Slide member 86 has outwardly extending pins on opposite sides thereof which cooperate with an arcuately shaped slot 87 in pivot arm 55. Referring to FIG. 3, it will be seen that the pins on slide member 86 are engaging one end of the slot 87 and are thus serving to limit further inward pivotal movement of pivot arm 55. The position of slide member 86 may be changed by rotating shaft 84 from externally of the housing. In this regard, it will be seen that an enlarged calibrated dial 88 cooperatess with the relatively small gear 85 on the outside of housing 11 to permit easily adjusting the maximum flow rate of the regulator from externally of the housing.

Figure 4:
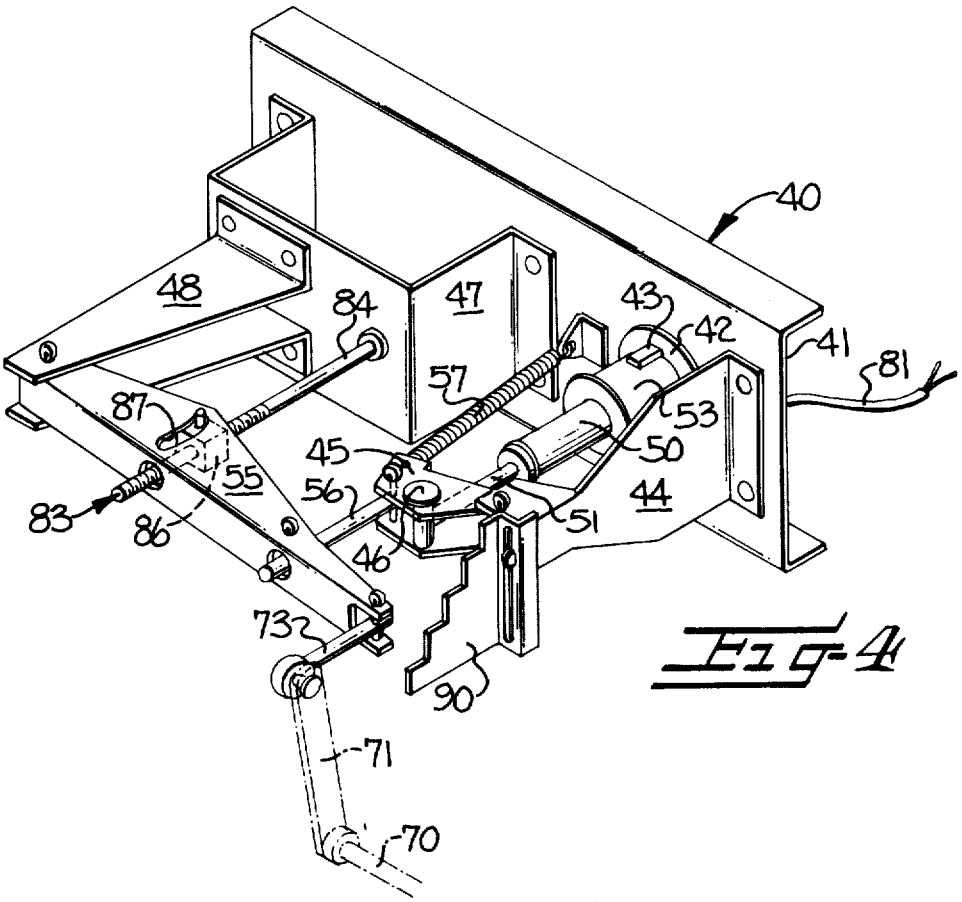
FIG. 4 is an enlarged isometric view of the control subassembly, showing in greater detail portions of the actuator means for effecting adjustment of the regulator and the adjustable limit means associated therewith.
Figure 5:
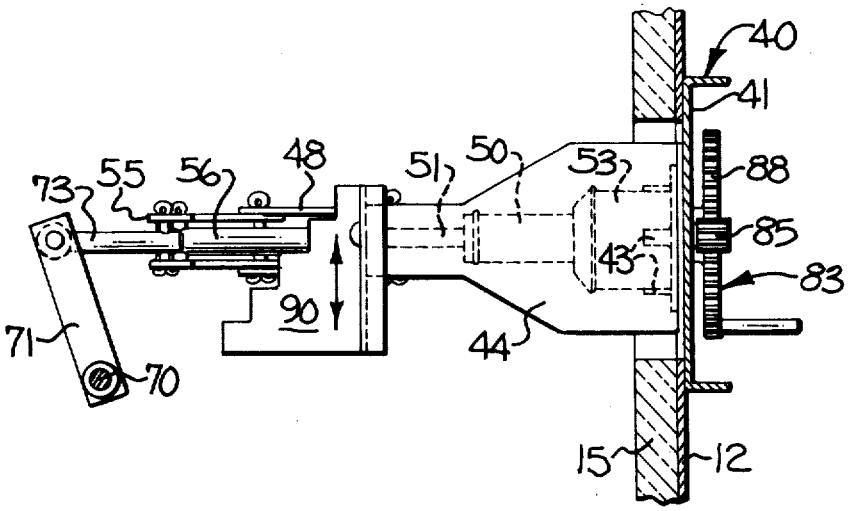
FIG. 5 is an end view of the subassembly illustrated in FIG. 4.

Adjustment of the minimum flow rate limit of the regulator is achieved by means of a slideably mounted stairstep shaped abutment 90 carried at the inner end of support bracket 44 and accessible through an inspection port, not shown, in housing 11. It will be seen in FIGS. 4 and 5 that the abutment 90 may be adjustable positioned so as to limit inward pivotal movement of pivot arm 55 to a predetermined position by engaging the pivot arm on one of the stair-step shaped surfaces of the abutment. Abutment 90 may be adjusted so that the regulator will maintain any desired predetermined minimum flow of air to a room or zone to maintain a minimum required level of circulation in the room. Also, the bracket may be adjusted, if desired, so that the regulator, at its minimum volume setting, will fully stop the flow of air.

In the drawings and specification, there has been set forth a preferred embodiment of the invention, and although specific terms are employed, they are used in a generic and descriptive sense only and not for purposes of limitation.

That which is claimed is:

1. Apparatus for adjustably controlling the flow of air in an air conditioning system and comprising a regulator having flow control means movable in response to fluctuations in the pressure of the air supplied to the regulator so as to variably restrict the flow of air through the regulator for thereby maintaining the flow of air passing through the regulator at a substantially constant rate, flow adjustment means cooperating with said flow control means for permitting varying the flow rate maintained by the flow control means and including means mounted for movement with respect to said flow control means and cooperating therewith for permitting varying the flow rate through the regulator from a maximum flow rate to a fully closed condition and through a infinite number of different flow rates therebetween, and actuator means cooperating with said flow adjustment means for effecting adjustment of the flow rate through the regulator and comprising a thermal motor having an axially movable shaft extending therefrom, heating means cooperating with said thermal motor for applying heat thereto to effect an axial movement to said motor shaft, and means cooperating with said thermal motor and operatively connecting the same to said flow adjustment means for effecting adjustment of the rate of flow through the regulator in response to the axial movement of said motor shaft.

2. Apparatus according to claim 1 wherein the axially movable shaft of said thermal motor moves toward an extended axial position upon application of heat to the thermal motor, and wherein said means cooperating with said motor shaft and operatively connecting the same to said flow adjustment means includes linkage means mechanically interconnecting said motor shaft and said flow adjustment means for effecting adjustment of said flow adjustment means upon axial movement of said motor shaft.

3. Apparatus according to claim 1 wherein the axially movable shaft of said thermal motor moves toward an extended axial position upon application of heat to the thermal motor, and wherein said actuator means includes means cooperating with said motor shaft for effecting movement of the same toward a retracted axial position upon cooling of the thermal motor.

4. Apparatus according to claim 1 wherein said flow control means includes a pair of airfoils mounted in opposing relation to one another in the path of air flow and being movable in response to fluctuations in the pressure of the air supplied to the regulator to define an air passageway of variable size for maintaining the flow of air passing through the regulator at a substantially constant rate.

5. Apparatus for adjustably controlling the flow of air in an air conditioning system and comprising a regulator having flow control means movable in response to fluctuations in the pressure of the air supplied to the regulator so as to variably restrict the flow of air through the regulator for thereby maintaining the flow of air passing through the regulator at a substantially constant rate, adjustable gate means located upstream of said flow control means in the path of air flow thereto and cooperating therewith for permitting varying the flow rate maintained by the flow control means, and actuator means cooperating with said adjustable gate means for effecting adjustment of the flow rate through the regulator and comprising a thermal motor having an axially movable shaft extending therefrom, heating means cooperating with said thermal motor for applying heat thereto to effect an axial movement to said motor shaft, and means cooperating with said thermal motor and operatively connecting the same to said adjustable gate means for effecting adjustment of the rate of flow through the regulator in response to the axial movement of said motor shaft.

6. Apparatus according to claim 5 wherein said regulator also includes adjustable limit means associated with said adjustable gate means for limiting the adjustment by said actuator means of the rate of air flow through the regulator within a predetermined range of flow rates.

7. Apparatus according to claim 6 wherein said adjustable limit means including respective maximum and minimum limit means, each cooperating with said adjustable gate means and each being adjustable for limiting the adjustment of the rate of air flow through the regulator within respective adjustable maximum and mimimum limits.

8. Apparatus for adjustably controlling the flow of air in an air conditioning system and comprising a regulator having flow control means including a pair of opposing airfoils pivotally mounted adjacent the upstream ends thereof in the path of air flow and being movable in response to fluctuations in the pressure of the air supplied to the regulator so as to variably restrict the flow of air through the regulator for thereby maintaining the flow of air passing through the regulator at a substantially constant rate, flow adjustment means cooperating with said flow control mens for permitting varying the flow rate maintained by the flow control means, and actuator means cooperating with said flow adjustment means for effecting adjustment of the flow rate through the regulator and comprising a thermal motor having an axially movable shaft extending therefrom, heating means cooperating with said thermal motor for applying heat thereto to effect an axial movement to said motor shaft, and means cooperating with said thermal motor and operatively connecting the same to said flow adjustment means for effecting adjustment of the rate of flow through the regulator in response to the axial movement of said motor shaft.

9. Apparatus according to claim 8 wherein said flow adjustment means includes adjustable gate means located upstream of said pair of airfoils and in the path of air flow thereto for varying the amount of airfoil surface exposed to the air flow to thereby vary the flow rate maintained by the airfoils.

10. Apparatus according to claim 9 wherein the axially movable shaft of said thermal motor has a relatively short stroke of movement, and wherein said means cooperating with said motor shaft and operatively connecting the same to said flow adjustment means comprises lever means interconnecting said motor shaft and said gate means for imparting a relatively large movement to said gate means in response to the relatively small axial movement of said motor shaft.

11. Apparatus for adjustably controlling the flow of air in an air conditioning system and comprising a regulator having flow control means including a pair of airfoils mounted in opposing relation to one another in the path of air flow and movable in response to fluctuations in the pressure of the air supplied to the regulator to define an air passageway of variable size for maintaining the flow of air passing through the regulator at a substantially constant rate, flow adjustment means including adjustable gate means located upstream of said pair of airfoils in the path of air flow thereto and cooperating with said airfoils for permitting varying the amount of airfoil surface exposed to the air flow to thereby adjust the flow rate maintained through the regulator, and actuator means cooperating with said flow adjustment means for effecting adjustment of the flow rate in response to a demand for an increased or decreased flow of air through the regulator and comprising a thermal motor having an axially movable shaft extending therefrom, thermostat means, heating means cooperating with said thermal motor and said thermostat means and being responsive to the thermostat means for applying heat to said thermal motor to effect an axial movement to said motor shaft, and means cooperating with said thermal motor and operatively connecting the same to said flow adjustment means for effecting adjustment of the rate of flow through the regulator in response to the axial movement of said motor shaft.

* * * * *